US007483669B2

(12) United States Patent
Satozaki

(10) Patent No.: US 7,483,669 B2
(45) Date of Patent: Jan. 27, 2009

(54) IMAGE-FORMING APPARATUS, IMAGE-FORMING SYSTEM, AND IMAGE-FORMING UNIT

(75) Inventor: Tetsuya Satozaki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 344 days.

(21) Appl. No.: 11/073,849

(22) Filed: Mar. 8, 2005

(65) Prior Publication Data

US 2005/0201793 A1 Sep. 15, 2005

(30) Foreign Application Priority Data

Mar. 9, 2004 (JP) ..... 2004-066427

(51) Int. Cl.
*G03G 15/00* (2006.01)

(52) U.S. Cl. ..... 399/405; 399/407

(58) Field of Classification Search ..... 399/405, 399/407

See application file for complete search history.

(56) References Cited

U.S. PATENT DOCUMENTS 5,887,239 A * 3/1999 Hong et al. ..... 399/405
5,995,800 A * 11/1999 Ahn ..... 399/361
6,263,185 B1 * 7/2001 Kato et al. ..... 399/381
6,353,727 B1 * 3/2002 Muraoka et al. ..... 399/410
6,449,459 B2 * 9/2002 Tamehira et al. ..... 399/405
6,690,901 B2 * 2/2004 Katsuyama et al. ..... 399/107
6,823,168 B2 * 11/2004 Sakuma ..... 399/405
6,865,356 B2 * 3/2005 Kaiho ..... 399/92
7,050,204 B1 * 5/2006 Sato et al. ..... 358/471
7,120,383 B2 * 10/2006 Sato et al. ..... 399/407
7,133,640 B2 * 11/2006 Zeller et al. ..... 399/410
7,245,854 B2 * 7/2007 Miyaji et al. ..... 399/124
7,251,451 B2 * 7/2007 Takagi et al. ..... 399/405

FOREIGN PATENT DOCUMENTS

JP 4-85260 3/1992

* cited by examiner

*Primary Examiner*—Anthony H. Nguyen
(74) *Attorney, Agent, or Firm*—Morgan Lewis & Bockius LLP

(57) ABSTRACT

An image-forming apparatus includes a first sheet output tray, an image-reading unit, and an image-forming unit provided below the image-reading unit. The image-reading unit and the image-forming unit form a sheet output space in which the first sheet output tray is provided, and the first sheet output tray includes a top board and a retractable plate provided on a top surface of the image-forming unit. The image-forming apparatus in accordance with the present invention is capable of enhancing sheet alignment capabilities in the case where only a single sheet output tray is used, providing additional sheet output trays having a layer structure, and further providing a sheet-transporting unit.

6 Claims, 5 Drawing Sheets

IMAGE-FORMING APPARATUS, IMAGE-FORMING SYSTEM, AND IMAGE-FORMING UNIT

BACKGROUND OF THE INVENTION

1. Field of the Invention

This invention relates to an image-forming apparatus, in particular, relates to an improvement of a sheet output mechanism.

2. Description of the Related Art

Conventionally, Japanese Patent Application Publication No. 4-85260 (hereinafter referred to as Document 1) discloses an output sheet-loading device in an image-forming apparatus. Document 1 provides an extending member and a supporting member that can vary a setting angle of the output sheet-loading device. Thus, the output sheet-loading device has excellent operability and loading capacity of the output sheets, prevents the output sheets from dropping, and piles up a great amount of papers thereon.

Recently, the image-forming apparatus includes an image-reading unit (scanner) and an image-forming unit. The image-forming unit includes an image-fixing unit and the like. The image-reading unit (scanner) and the image-forming unit are provided separately above and below so that an output sheet-loading tray for printed sheets may not protrude from the side faces of the image-forming apparatus. An output sheet-loading unit is arranged in a space between the separately arranged image-reading unit (scanner) and the image-forming unit.

Also in recent years, with the background of advancements in the complex capabilities of the image-forming apparatus, the place where the output sheet is loaded or ejected can be selected for every use or every user. Multiple sheet output trays are provided. Additionally, an optional device such as a sorting unit can be connected.

Document 1 proposes the device that has excellent operability and loading capacity of the output sheets, prevents the output sheets from dropping, and piles up a great amount of sheets thereon. However, the image-forming apparatus disclosed in Document 1 does not include the image reading unit (scanner) and the image-forming unit arranged separately above and below, and does not utilize the space between the separately arranged the image reading unit (scanner) and the image-forming unit. In particular, Document 1 does not include the multiple sheet output trays or a sheet-feeding unit that transports the output paper to the sorting unit.

SUMMARY OF THE INVENTION

The present invention has been made in view of the above circumstances and provides a highly scalable image-forming apparatus. Specifically, the image-forming apparatus in accordance with the present invention is capable of enhancing sheet alignment capabilities in the case where only a single sheet output tray is used, providing additional sheet output trays having a layer structure, and further providing a sheet-transporting unit.

According to one aspect of the present invention, there is provided an image-forming apparatus including a first sheet output tray, an image-reading unit; and an image-forming unit provided below the image-reading unit. The image-reading unit and the image-forming unit form a sheet output space in which the first sheet output tray is provided, and the first sheet output tray includes a top board and a retractable plate provided on a top surface of the image-forming unit. The above-mentioned retractable plate makes it possible to change a shape of the first sheet output tray, according to the usage of the image-forming apparatus. That is, without any optional unit added to the first sheet output tray, the shape of the first sheet output tray can be selected according to the importance of the sheet alignment or easy take out of the sheet. In the case where the optional unit is mounted on the first sheet output tray, any inconvenience can be eliminated in mounting the optional unit, or the first sheet output tray has the shape on which the optional unit can be mounted easily.

According to another aspect of the present invention, there is provided an image-forming system including a sorting unit, an image-forming unit including a first sheet output tray, an image-reading unit, and an image-forming unit, and a sheet-transporting unit provided on a top board to transport a sheet to another peripheral device, the image-reading unit and the image-forming unit form a sheet output space in which the first sheet output tray is provided, and the first sheet output tray includes a top board and a retractable plate provided on a top surface of the image-forming unit. The above-mentioned image-forming apparatus can be connected to the peripheral device such as the sorting unit. In the case where the sorting unit is connected to the image-forming apparatus having the sheet-transporting unit, the image-forming system can be realized with various advanced capabilities. The sorting unit is capable of including sorting capabilities, staple capabilities, and the like.

According to a further aspect of the present invention, there is provided an image-forming unit includes a top board forming an image-forming portion forms a part of a first sheet output tray. The first sheet output tray includes a retractable plate provided on a top surface of the image-forming portion. The image-reading portion and the image-forming unit are respectively unitized. The image-forming portion can be connected to the image-forming unit to compose the image-forming unit. In this image-forming unit, the top board includes the concave slop for housing the retractable plate in the retracted state.

BRIEF DESCRIPTION OF THE DRAWINGS

Embodiments of the present invention will be described in detail based on the following figures, wherein.

DESCRIPTION OF THE EMBODIMENTS

A description will now be given, with reference to the accompanying drawings, of embodiments of the present invention.

First Embodiment

Figure 1:
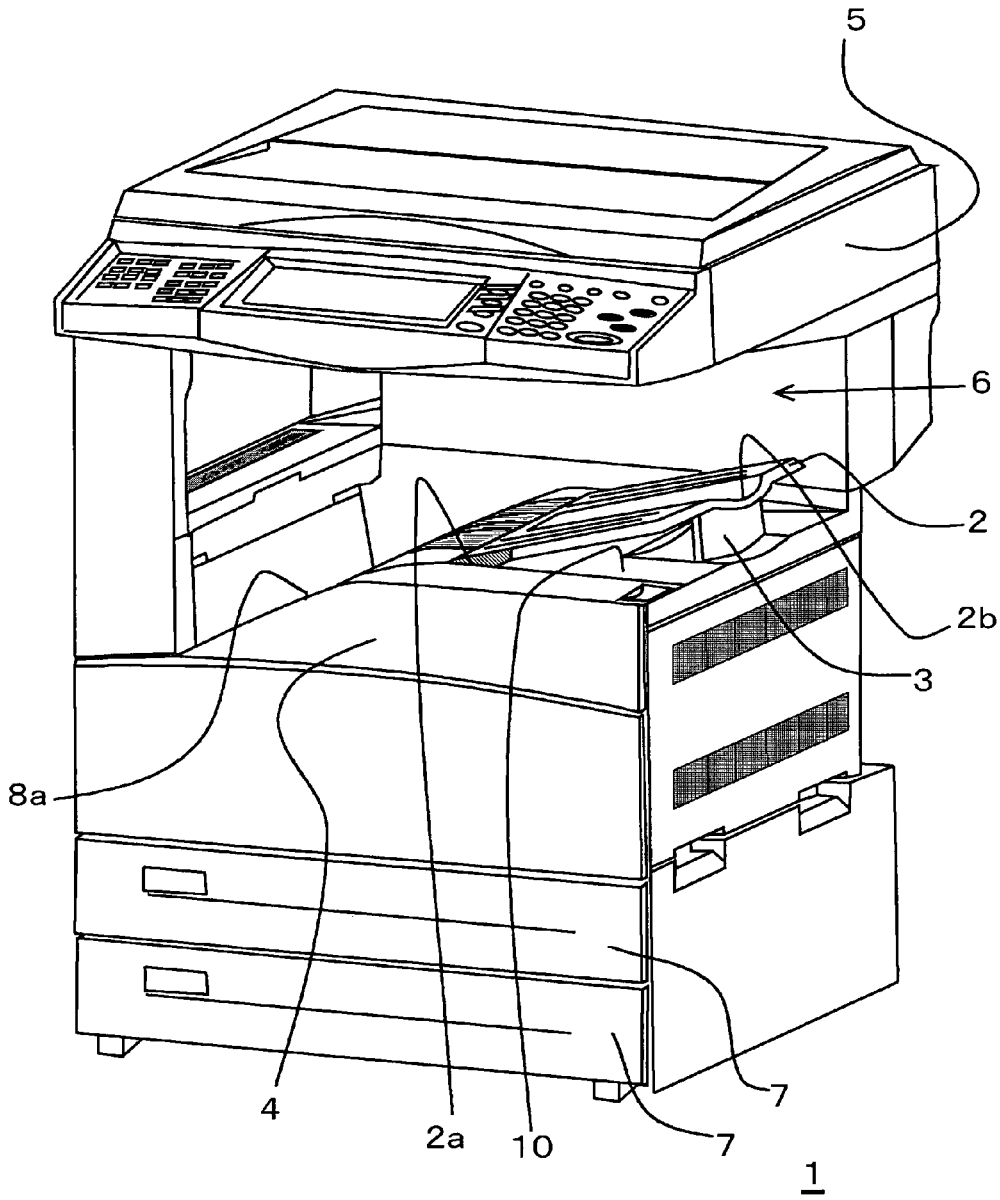
FIG. 1 is a perspective view of the image-forming apparatus having a retractable plate in a standing state in accordance with embodiments of the present invention.
Figure 2:
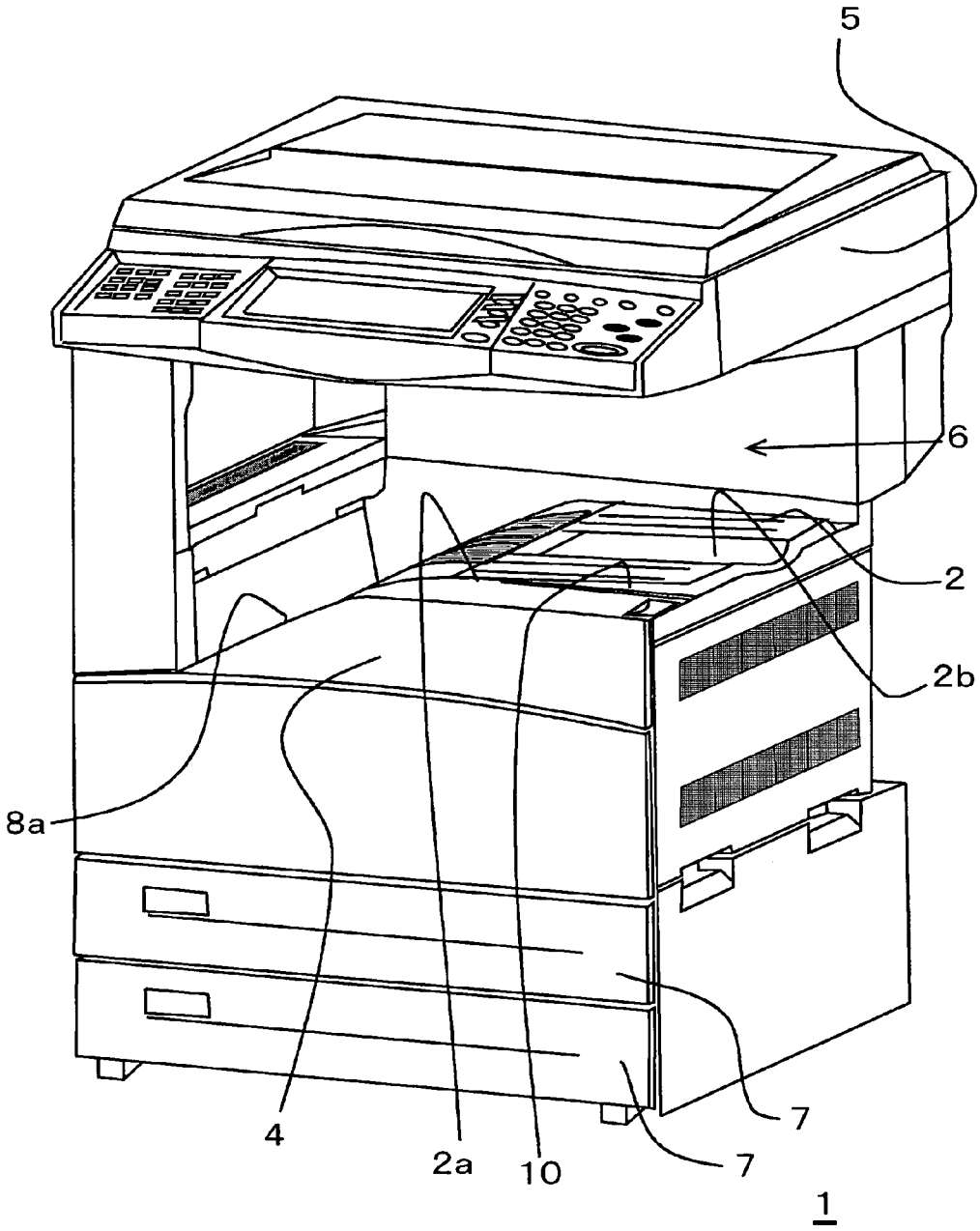
FIG. 2 is a perspective view of the image-forming apparatus having the retractable plate in a retracted state in accordance with the embodiments of the present invention.
Figure 3:
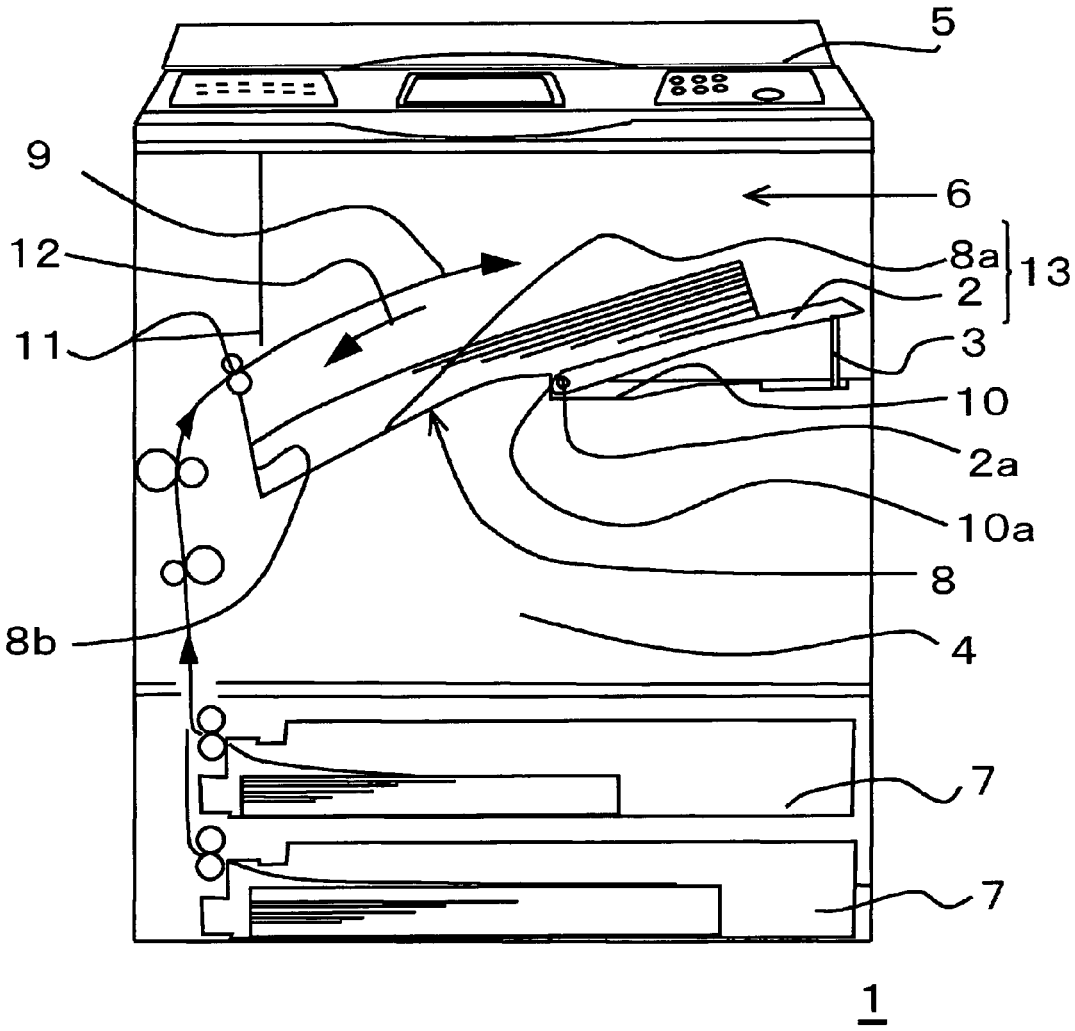
FIG. 3 illustrates how a sheet is output and fed in the image-forming apparatus shown in FIG. 1.

FIG. 1 and FIG. 2 illustrate an image-forming apparatus 1 in accordance with a first embodiment of the present invention. FIG. 1 is a perspective view of the image-forming apparatus 1. Referring to FIG. 1, a retractable plate 2 can be supported by a stopper 3. As shown in FIG. 1, the retractable plate 2 is supported by the stopper 3. FIG. 2 is also a perspective view of the image-forming apparatus 1. Referring to FIG. 2, the retractable plate 2 is not supported by the stopper 3, and the retractable plate 2 is in a retracted state. FIG. 3 illustrates how a sheet is output and fed in the image-forming apparatus 1 shown in FIG. 1.

The image-forming apparatus 1 includes sheet feeding trays 7, an image-forming unit 4, and an image-reading unit 5. The sheet feeding trays 7 are arranged in a two-tiered structure. The image-forming unit 4 is arranged on the sheet feeding trays 7. The image-reading unit 5 is arranged above the image-forming unit 4. The image-reading unit 5 has a substantially plane bottom surface. There is a space between the image-forming unit 4 and the image-reading unit 5. In other words, the image-forming unit 4 and the image-reading unit 5 form a sheet output space 6. The image-reading unit 5 includes a user interface unit having buttons and a display as a single unit. The buttons are used for inputting an instruction into the image-forming apparatus 1.

The image-forming unit 4 includes an output roll 11 and a top board 8. As shown in FIG. 3, the top board 8 includes a slope 8*a* and a concave slope 10. The slope 8*a* is arranged on a starting point of an arrow 9 that shows an output direction. The concave slope 10 is arranged on an ending point of the arrow 9. The retractable plate 2 is secured to the concave slope 10. A supporting point 2*a* corresponds to an output direction starting point 10*a*. The retractable plate 2 includes a concave portion 2*b* thereon so that an output paper can be pulled out easily. A first sheet output tray 13 is formed by the retractable plate 2 and the slope 8*a*.

The image-forming unit 4 includes the stopper 3 as shown in FIG. 1 and FIG. 3. The stopper 3 is capable of holding the retractable plate 2 to make the retractable plate 2 in a standing state. Also, the image-forming unit 4 includes, for example, a holding unit such as a snapfit, not shown, so as to secure the retractable plate 2 when the retractable plate 2 is in a retracted state. The image-fixing unit and an image-developing unit are omitted in FIG. 3.

With thus configured image-forming apparatus 1, a paper is fed by the sheet feeding trays 7, printed and output onto the first sheet output tray 13 through the output roll 11. Here, the retractable plate 2 is capable of changing the state depending on the use. For example, in the case where the alignment of the output sheets is important, the retractable plate 2 is supported by the stopper 3 to be in the standing state, as shown in FIG. 1. In the standing state of the retractable plate 2, the sheet is output along the arrow 9 and slides to the direction of an arrow 12 according to angles of the retractable plate 2 and the slope 8*a*. The output sheet thus gets touch with an end face 8*b* of the slope Ba. The output sheets are aligned as shown in FIG. 3.

In the case where the output sheet can be pulled out easily, the stopper 3 is released. As shown in FIG. 2, the retractable plate 2 is retracted into the concave slope 10 to be in the retracted state. In the retracted state of the retractable plate 2, the retractable plate 2 becomes substantially plane, and it is more spacious between the retractable plate 2 and the image-reading unit 5. It is thus possible to insert a hand into the sheet output space 6.

In accordance with the first embodiment of the present invention, in the case where the retractable plate 2 is supported by the stopper 3 in the standing state, the difference in height between a top surface of the retractable plate 2 and a bottom surface of the image-reading unit 5 is larger than the difference in height between the output roll 11 and the top surface of the retractable plate 2, namely, the difference in height between a left lower end of the first sheet output tray 13 and a position of the output roll 11.

Second Embodiment

A description will be given of a second embodiment of the present invention, with reference to FIG. 4. The sheet output space 6 of the image-forming apparatus 1 includes a second sheet output tray 14. An output roll 15 is additionally provided on the output roll 11.

Here, the retractable plate 2 is released from the stopper 3, and is secured by the snapfit, not shown. With the above-mentioned configuration, an interval can be maintained between the first sheet output tray 13 and the second sheet output tray 14. If the second sheet output tray 14 is added and the retractable plate 2 is in the standing state, the interval becomes closer between the first sheet output tray 13 and the second sheet output tray 14. The number of output sheets to be mounted on the first sheet output tray 13 is limited, and the output papers may not be taken out easily.

Figure 4:
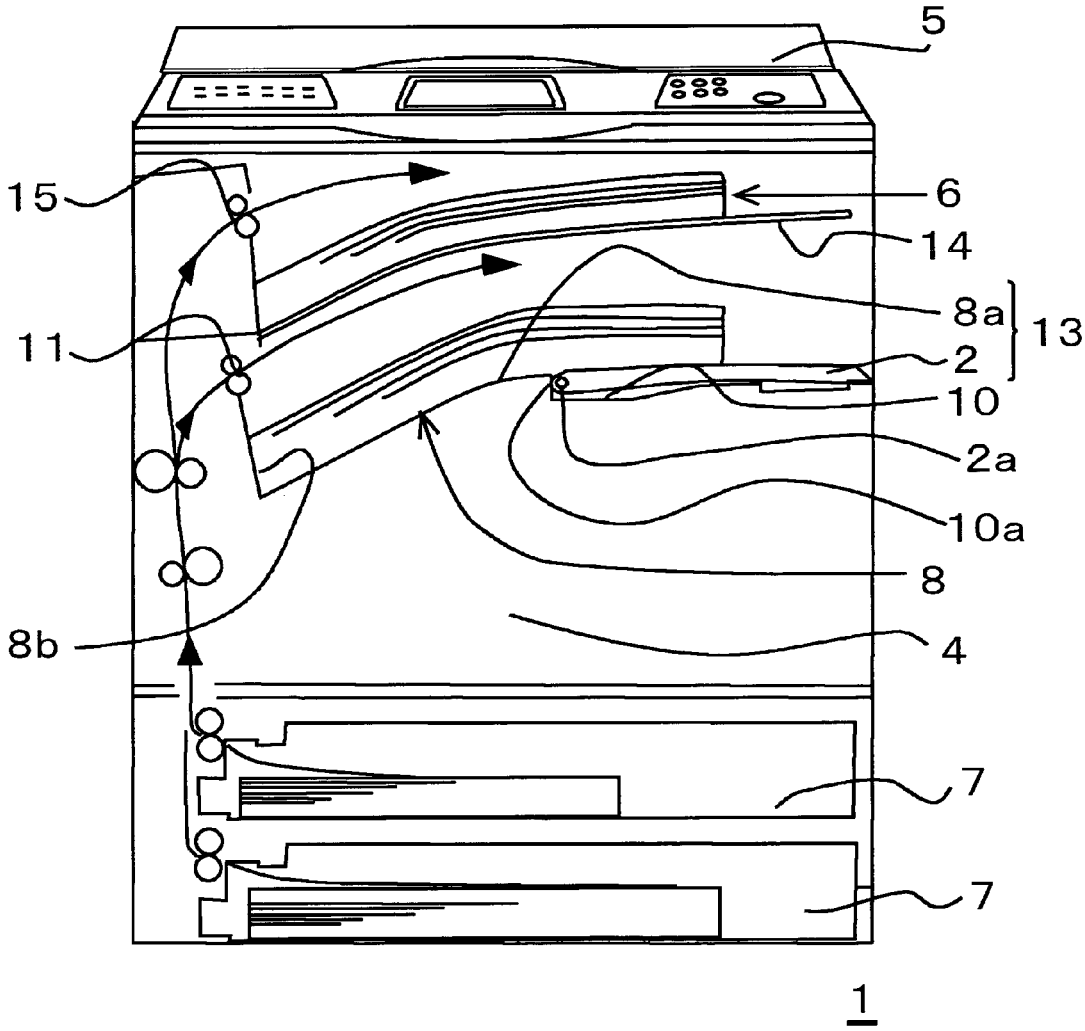
FIG. 4 illustrates how a sheet is output and fed in the image-forming apparatus in the case where a second sheet output tray is mounted.

However, with the configuration as shown in FIG. 4, more output sheets can be mounted on the first sheet output tray 13, and the output sheets can be taken out easily.

In accordance with the second embodiment of the present invention, the difference in height between the output roll 11 and the first sheet output tray 13 is configured to be almost identical to the difference in height between the output roll 15 and the second sheet output tray 14. However, the difference in height between the retractable plate 2 and the second sheet output tray 14 is larger than the difference in height between the second sheet output tray 14 and the bottom surface of the image-reading unit 5. This is because if the sheet is output from a discharging portion close to the image-fixing unit, the output paper gets curled easily. This can take a more space.

In the second embodiment of the present invention, the same components and configurations as those of the first embodiment have the same reference numerals and a detailed explanation will be omitted, if not otherwise specified.

Third Embodiment

Figure 5:
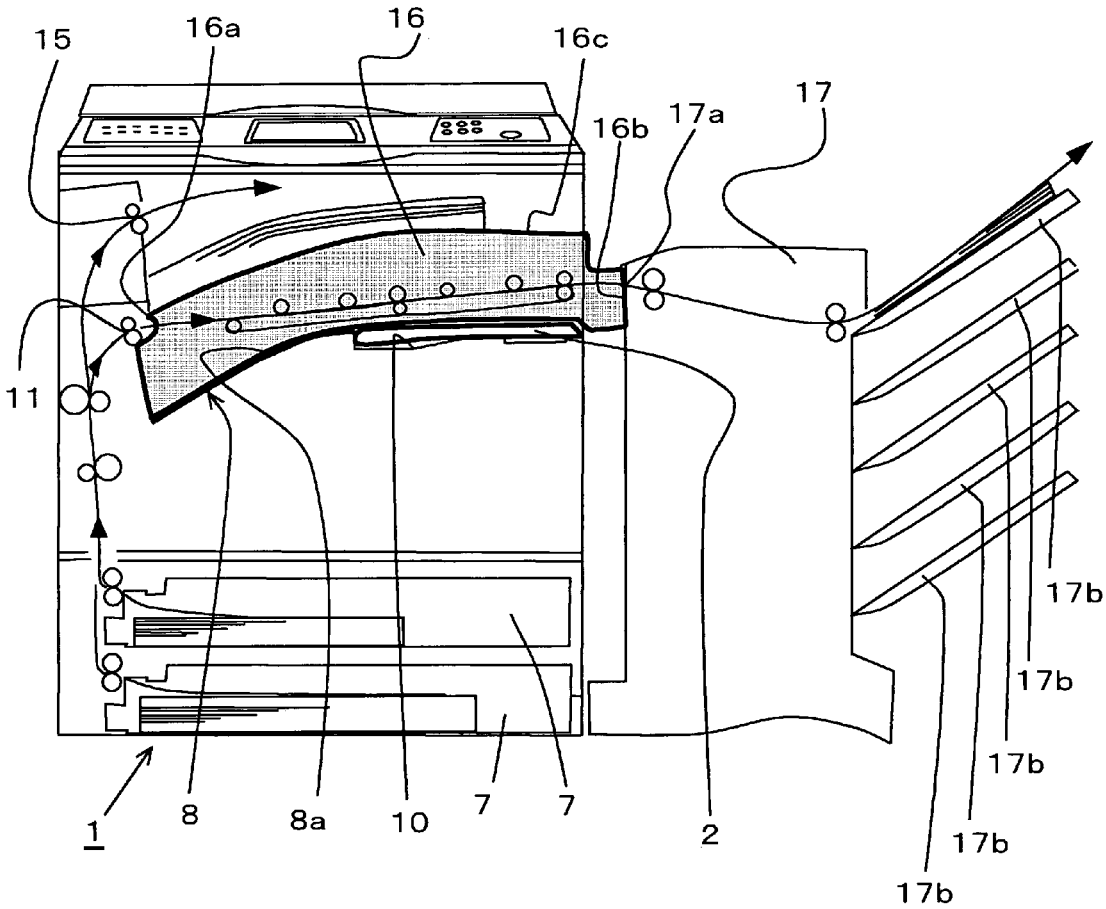
FIG. 5 illustrates an output sheet-transporting unit provided on a top surface of the image-forming unit and a sheet is output, transported, and fed in a sorting unit.

A description will be given of a third embodiment of the present invention, with reference to FIG. 5. The image-forming apparatus 1 shown in FIG. 5 includes the top board 8 and an output sheet-transporting unit 16. The output sheet-transporting unit 16 is mounted on the top board 8, which is included in the image-forming apparatus 1 as shown in FIG. 1. A sorting unit 17 is connected to the output sheet-transporting unit 16 as shown in FIG. 5. The output sheet-transporting unit 16 is shown as hatching so as to be distinguished from other members.

The output sheet-transporting unit 16 is housed in the concave slope 10 as shown in FIG. 5. The output sheet-transporting unit 16 is in contact with the top surface of the retractable plate 2 and the slope 8*a* of the top board 8, and is mounted in a stable state. The retractable plate 2 is housed in the concave slope 10 in the retracted state. The retractable plate 2 does not become an obstacle when the output sheet-transporting unit 16 is mounted. Thus, the scalability of the image-forming apparatus can be achieved even with the identical image-forming apparatus 1 in accordance with the first and second embodiments of the present invention.

The position of an output sheet inlet 16*a* corresponds to that of the output roller 11. The output sheet inlet 16*a* is included in the output sheet-transporting unit 16 and is mounted on the image-forming unit 4. The position of an output sheet outlet 16*b* of the output sheet-transporting unit 16 corresponds to a sort sheet inlet 17*a* of the sorting unit 17. The sheet output from the output roll 11 is taken into the output sheet-transporting unit 16 from the output sheet inlet 1*a*. That is, the sheet is output into the first sheet output tray 13 from the output roll 11 in accordance with the first embodiment of the present invention. However, the sheet is output into the output sheet-transporting unit 16 from the output roll 11 in accordance with the third embodiment of the present invention. The sheet output into the output sheet-transporting unit 16 passes through the output sheet outlet 16*b*, and is taken into the sorting unit 17 from the sort sheet inlet 17*a*. The sorting unit 17 sorts and outputs the output sheets onto a third sheet output tray 17*b*.

In the third embodiment of the present invention, the second sheet output tray 14 is not included, although the second sheet output tray 14 is included in the second embodiment of the present invention. However, the sheet output from the output roll 11 can be loaded on a top surface 16*c* of the sheet-transporting unit 16.

A space is provided on the substantially whole surface of the top surface 16*c* of the output sheet-transporting unit 16 and between the top surface 16*c* of the output sheet-transporting unit 16 and a bottom surface of the image-reading unit 5. As shown in FIG. 5, the sorting unit 17 is provided on the left side of the image-forming apparatus 1, and is provided at a position lower than the top surface 16*c* of the sheet-transporting unit 16. The output sheet outlet 16*b* is also provided at a position lower than the top surface 16*c* of the sheet-transporting unit 16. It is thus possible to take out the sheets output onto the top surface 16*c* of the sheet-transporting unit 16, from the side of the sorting unit 17. A tilt angle of the top surface 16*c* of the sheet-transporting unit 16 is formed along the angle of the top board 8 in the image-forming unit 4. That is, the tilt angle of the top surface 16*c* of the sheet-transporting unit 16 is almost plane, as compared to the tilt angle of an upper part of the retractable plate 2 in the standing state. This is because the sheet is output on the top surface 16*c* of the sheet-transporting unit 16 from the output sheet outlet relatively far from the image-fixing unit, and the output sheet is not curled easily. It is thus possible to mount the output sheets more, even if the sheet-transporting unit 16 is provided.

In the third embodiment of the present invention, the same components and configurations as those of the first embodiment have the same reference numerals and a detailed explanation will be omitted, if not otherwise specified.

Although a few embodiments of the present invention have been shown and described, it would be appreciated by those skilled in the art that changes may be made in these embodiments without departing from the principles and spirit of the invention, the scope of which is defined in the claims and their equivalents.

In addition, the image-forming portion corresponds to the image-forming unit including the retractable plate 2. The image-forming portion may be connected with the image-reading unit or the like. An image-forming system of the present invention corresponds to the image-forming apparatus 1 to which the sorting unit 17 is connected.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

The entire disclosure of Japanese Patent Application No. 2004-066427 filed on Mar. 9, 2004 including specification, claims, drawings, and abstract is incorporated herein by reference in its entirety.

What is claimed is:

1. An image-forming apparatus comprising:

a first sheet output tray;

an image-reading unit; and an image-forming unit provided below the image-reading unit, wherein:

the image-reading unit and the image-forming unit form a sheet output space in which the first sheet output tray is provided; and the first sheet output tray includes a top board and a retractable plate provided on a top surface of the image-forming unit, the retractable plate including a concave portion, and the retractable plate in a standing state being located along a slope of the top board.

2. The image-forming apparatus as claimed in claim 1, wherein the top board includes a concave slope for housing the retractable plate in a retracted state.

3. The image-forming apparatus as claimed in claim 1, wherein a difference in height between a top surface of the retractable plate and a bottom surface of the image-reading unit is greater than the difference in height between a position from which a sheet on which an image has been formed by the image-forming unit is output and the top surface of the retractable plate.

4. An image-forming unit comprising:

a top board forming an image-forming portion, the top board also forming a part of a first sheet output tray, wherein the first sheet output tray includes a retractable plate provided on a top surface of the image-forming portion, the retractable plate including a concave portion, and the retractable plate in a standing state being located along a slope of the top board.

5. The image-forming unit as claimed in claim 4, wherein the top board includes a concave slope for housing the retractable plate in a retracted state.

6. An image-forming apparatus comprising:

a first sheet output tray;

an image-reading unit; and an image-forming unit provided below the image-reading unit, wherein:

the image-reading unit and the image-forming unit form a sheet output space in which the first sheet output tray is provided;

the first sheet output tray includes a top board and a retractable plate provided on a top surface of the image-forming unit, the retractable plate including a concave portion; and the first sheet output tray includes a stopper that is capable of holding the retractable plate in a standing state.

* * * * *